United States Patent [19]

Krizan et al.

[11] Patent Number: 4,923,511

[45] Date of Patent: May 8, 1990

[54] TUNGSTEN CARBIDE HARDFACING POWDERS AND COMPOSITIONS THEREOF FOR PLASMA-TRANSFERRED-ARC DEPOSITION

[75] Inventors: James A. Krizan, Baden, Pa.; Richard S. Szereto, Willowick, Ohio

[73] Assignee: W S Alloys, Inc., Ambridge, Pa.

[21] Appl. No.: 372,848

[22] Filed: Jun. 29, 1989

[51] Int. Cl.[5] ..... C22C 29/06

[52] U.S. Cl. ..... 75/252; 75/240; 75/242

[58] Field of Search ..... 75/241, 252, 242, 255; 427/422, 376.3, 376.7; 428/615

[56] References Cited

U.S. PATENT DOCUMENTS

| | | | |
|---|---|---|---|
| 3,746,519 | 7/1973 | Hara et al. | 75/240 |
| 3,859,057 | 1/1975 | Stoll et al. | 75/208 |
| 3,989,554 | 11/1976 | Wisler | 285/333 |
| 4,024,902 | 5/1977 | Baum | 75/240 |
| 4,066,451 | 11/1978 | Rudy | 75/240 |
| 4,101,319 | 7/1978 | Beyer et al. | 75/252 |
| 4,163,071 | 7/1979 | Weatherly et al. | 427/34 |
| 4,173,685 | 11/1979 | Weatherly | 75/238 |
| 4,320,156 | 3/1982 | Oakes et al. | 427/213 |
| 4,339,272 | 7/1982 | Grover et al. | 75/240 |
| 4,376,793 | 3/1983 | Jackson | 427/34 |
| 4,414,029 | 11/1983 | Newman et al. | 75/252 |
| 4,466,829 | 8/1984 | Nishigaki et al. | 75/240 |
| 4,497,660 | 2/1985 | Lindholm | 75/240 |
| 4,507,151 | 3/1985 | Simm et al. | 106/1.05 |
| 4,519,840 | 5/1985 | Jackson et al. | 106/1.05 |
| 4,609,401 | 9/1986 | Simm et al. | 75/252 |
| 4,666,797 | 5/1987 | Newman et al. | 75/252 |
| 4,678,511 | 7/1987 | Yasuoka et al. | 75/251 |
| 4,725,098 | 2/1988 | Beach | 299/79 |
| 4,756,841 | 7/1988 | Buran et al. | 252/26 |

*Primary Examiner*—Stephen J. Lechert, Jr.
*Assistant Examiner*—Nina Bhat
*Attorney, Agent, or Firm*—Sixbey, Friedman, Leedom & Ferguson

[57] ABSTRACT

Disclosed is a hardfacing powder to be deposited by plasma-transferred-arc welding on a substrate so as to provide a facing of super-hard material that can be utilized as a wear resistant surface. Particular examples of use include mining, agricultural, construction, railroad and plastic extrusion molding equipment.

The hardfacing powder of the present invention includes a plurality of different types of tungsten carbide, particularly $W_2C$ and WC-Co, within a matrix alloy of carbon 0.017–0.52% by weight, silicon 4.3–4.7% by weight, boron 2.7–3.3% by weight, iron 0.27–0.40% by weight and the balance nickel. The total content of tungsten carbide is at least 50% of the total powder by weight.

The result is a facing that is improved in compression as well as shear impact resistance that lasts longer in use and has a lower manufacturing cost than conventional hardened metals.

12 Claims, No Drawings

TUNGSTEN CARBIDE HARDFACING POWDERS AND COMPOSITIONS THEREOF FOR PLASMA-TRANSFERRED-ARC DEPOSITION

TECHNICAL FIELD

The present invention is generally related to hardfacing welding powders for deposition by plasma-transferred-arc powder surfacing equipment. More particularly, these powders have compositions that are relatively high in tungsten carbide content and include nickel as the major component of the matrix alloy.

BACKGROUND OF THE INVENTION

Many tungsten carbide hardfacing compositions useful for deposition by the plasma-transferred-arc process are known in the art. The aforementioned compositions have been applied as facings to prevent premature wear on mining, agricultural and plastic extrusion molding equipment.

The types of tungsten carbide bearing hardfacing compositions of the prior art are typified by having matrices of approximately the composition chromium 13.5% by weight, carbon 0.75% by weight, silicon 4.25% by weight, iron 4.75% by weight, boron 3.0% by weight with nickel comprising the balance. The amounts of tungsten carbide present in these blends typically range from 30 to 50% by weight. The overlays produced by plasma-transferred-arc deposition of these blends generally exhibit matrix hardnesses measured by the Rockwell C hardness test in the 50 to 60 range with approximately 80 to 85% retention of carbides from the starting composition.

Also, the presence of large amounts of chromium in the aforementioned matrices can disadvantageously lead to the formation of coarse, acicular chromium carbides (depending upon the welding conditions) with their corresponding detrimental effect upon impact resistance. More typically, the chromium combines with the boron present to form chromium borides which also disadvantageously contribute to brittleness in the matrix alloy. Since the matrix alloys above-described are inherently poor in impact resistance due to the relatively high chromium content, carbide additions have been kept at or below 50% by weight so as not to exacerbate this condition. However, the chromium has been considered necessary in prior art powders because of its hardening quality and its ability to enhance fluidity. That is to say, the chromium acts as a hardening factor in the matrix alloy and helps sustain the flow ability of the molten material for deposition. As a result, the poor impact resistance and brittleness of the matrix alloys is only worsened by the addition of more carbide; particularly with regard to sheer loading. Moreover, the increased brittleness results in the formation of cracks and pores in the overlays, which become even more prevalent with increased overlay thicknesses or number of layers.

Other prior art hardfacing powders are also known in the art for spray deposition by thermal spraying processes. These thermal spray powders are fundamentally different from welding powders, such as applied by the aforementioned plasma-transferred-arc welding process, because the thermal spray processes simply spray molten alloy onto a substrate for coating without metallurgical bonding. These processes are typified by the use of a flame to melt the powders which are limited to the lower available temperatures associated with a particular flame. Thus, without metallurgical bonding, the hardface overlays can be easily broken away from the substrate by an impact. Furthermore, the powders used for thermal spraying generally include melting alloys to assist in melting at the lower temperatures and fluxing agents in an attempt to increase bonding strength between the overlay and the substrate. The result is the production of a softer and less impact-resistant overlay. In contradistinction, a welding process forms a metallurgical bonding between the molten alloy of the overlay by forming a weld pool on the surface of a substrate of sufficient temperature to metallurgically bond with the substrate metal. This can be accomplished with the heat generated in a plasma-transferred-arc welding process. As a result, welded overlays cannot be easily broken free of the substrate on impact.

One known attempt at increasing bonding strength in a thermal spray powder includes an amount of nickel-aluminide in the composition. The nickel-aluminite actually creates more heat than the thermal sprayer, and this increased heat is used in bonding. However, the heat generated still falls short of the welding processes.

SUMMARY OF THE INVENTION

It is thus a primary object of the present invention to provide a hardfacing powder suitable for deposition by a welding system that overcomes the above-noted problems and deficiencies of the prior art.

It is a further object of this invention to provide a hardfacing powder suitable for deposition by the plasma-transferred-arc powder surfacing process with tungsten carbide contents in excess of 50% by weight.

It is yet another object of this invention to provide a hardfacing powder with an improved ability to withstand impact whether the loading on the overlay be in compression or shear.

It is yet another object of this invention to provide a hardfacing powder with the ability to generate essentially crack and pore free overlays regardless of overlay thickness or number of layers deposited to achieve same.

It is still another object of the present invention to provide a chromium free welding powder that has the ability to generate a dense alloyed overlay with substantially no air pockets, cracks or pores which can withstand greater impact than prior art alloys and will metallurgically bond to the applied substrate.

The above-noted objects and advantages of the present invention can be obtained by a hardfacing powder blend including a matrix alloy of carbon, silicon, boron, iron and mostly nickel, with two types of tungsten carbide metal particles, WC-Co and $W_2C$, adding up to at least 50% by weight of the total composition.

DETAILED DESCRIPTION OF THE PREFERRED EMBODIMENTS

Described below is a hardfacing powder and composition thereof which is used in a welding process to overlay or coat another substrate surface, i.e. steel, so as to provide an improved wear resistant facing that can be utilized on any wear surface of machinery or equipment. Particular examples of applicability include mining, agriculture, railroad, and plastic extrusion molding equipment.

Preferably, the welding process used to apply the hardfacing overlay includes the use of plasma-transferred-arc powder surfacing equipment, which is conventionally known and commonly available. Basically, this process includes the melting of the powder blend at temperatures above 14,000 degrees Farenheit at the arc of the equipment, and the subsequent deposition of the molten alloy onto the substrate to be overlayed. The molten alloy forms a weld pool on the substrate, which is of a sufficiently high temperature to metallurgically bond or weld to the metal of the substrate and thereafter solidifies to form the hardfacing overlay. The thickness of the overlay can be varied by controlling the amount of hardfacing powder supplied to the welder and the volume per time of deposition. Alternatively, the thickness of the facing can be increased by building up multiple layers, each of which weld to the previous layer. It is also understood that other welding techniques can be used as they are developed to deposit the hardfaced overlay.

It has been found, in accordance with the present invention, that making use of a matrix alloy with the composition carbon 0.017–0.052% by weight, silicon 4.3–4.7% by weight, boron 2.7–3.3% by weight, iron 0.27–0.40% by weight and the balance nickel allows the addition of WC-Co metal particles 30–40% by weight and the further addition of $W_2C$ metal particles 20 to 50% by weight for a total combined carbide content of up to 80% by weight without deleterious effect upon the hardfacing deposit.

It has been further found that the percentage of cobalt present in the WC-Co component has little or no effect upon either the weldability or the efficacy of the deposit when the cobalt content ranges from 5 to 18% of the total WC-Co component. This allows for the use of reclaimed WC-Co (or more commonly known as Commercial Grade Bulk Metal) as the WC-Co component with its associated lower cost versus "virgin" material.

The following examples are given by way of illustration to further explain the principles of the invention. These examples are merely illustrative and are not to be understood as limiting the scope and underlying principles of the invention in any way.

EXAMPLE 1

A blend of 30% by weight WC-Co metal particles and 20% by weight $W_2C$ metal particles was mixed with 50% by weight matrix alloy comprised of carbon 0.017–0.052% by weight, silicon 4.3–4.73% by weight, boron 2.7–3.3% by weight, iron 0.27–0.40% by weight and balance nickel. The mesh range of the WC-Co, $W_2C$ component being −140+325 (Tyler) and the mesh range of the matrix alloy component being −80+325 (Tyler). The prepared powder was deposited on a mild steel (1040 grade) substrate by the Plasma-Transferred-Arc Powder Surfacing process to an as-welded thickness of approximately 0.035 inches. The deposit was subsequently ground to a finish thickness of approximately 0.020 inches and tested in service as the fixed portion of a reel type cutting blade assembly used in agriculture. This part is normally made from various grades of air hardening tool steels heat treated for maximum hardness and wear resistance. Test studies showed the useful life of the tool steel part varied from days to weeks depending upon cutting conditions. The hardfaced mild steel part consistently demonstrated life span increases of a factor of 3 over the best hardened tool steel life span irregardless of the cutting conditions at a substantially lower cost of manufacture.

EXAMPLE 2

A blend of 30% by weight WC-Co metal particles and 30% by weight $W_2C$ metal particles was mixed with 40% by weight matrix alloy comprised of carbon 0.017–0.052% by weight, silicon 4.3–4.7% by weight, boron 2.7–3.3% by weight, iron 0.27–0.40% by weight and balance nickel. The mesh range of the WC-Co, $W_2C$ component being −140+325 (Tyler) and the mesh range of the matrix alloy component being −80+325 (Tyler). The prepared powder was deposited on a 4140 steel substrate heat-treated to a Rockwell C hardness of 35–40 by the Plasma-Transferred-Arc Powder Surfacing process to a thickness of approximately 0.060 inches. The aforementioned part, being the working component of a tamping tool used for leveling railroad road-bed ballast, is subject to severe wash (or erosion) due to the extremely abrasive nature of the ballast material. This part had been previously made of D-7 tool steel heat-treated to a Rockwell C 62+ hardness and mechanically fixed to a shank by means of hardened cap screws. These tools are expected to last for a period of approximately 4 months due to the expense of their manufacture. It was found during testing of the hardfaced version that this tool lasts at least 6 months in service at a much lower cost of manufacture. Moreover, the hardfaced version has shown the potential for even a longer service life, subject to further testing.

It is also contemplated that the thickness of any one overlay can be increased or multiple layers added to directly increase service life, while still maintaining the benefits of the lower manufacturing costs associated with the welding powder of this invention.

The above-noted examples exhibited essentially crack and pore free overlays which retained 90+% of the starting amount of the tungsten carbide component with no apparent thickness or number of layer limitations. Moreover, under microscopic examination, the overlays exhibited a high density with substantially no air pockets.

We claim:

1. A hardfacing powder blend for deposition on a substrate by welding, comprised of: a plurality of different types of tungsten carbide metal particles including at least WC-Co and $W_2C$ particles and a matrix alloy containing nickel, wherein the total content of tungsten carbide in said powder is at least 50% by weight.

2. The hardfacing powder blend of claim 1, wherein said WC-Co particles are provided at 30 to 40% by weight and said $W_2C$ particles are provided at 20 to 50% by weight.

3. The hardfacing powder blend of claim 1, wherein said matrix alloy includes carbon at 0.017–0.052% by weight, silicon at 4.3–4.7% by weight, boron at 2.7–3.3% by weight and iron at 0.27–0.40% by weight with nickel as the balance.

4. The hardfacing powder blend of claim 3, wherein said WC-Co particles are provided at 30 to 40% by weight and said $W_2C$ particles are provided at 20 to 50% by weight.

5. The hardfacing powder blend of claim 4, wherein the cobalt content of the WC-Co particles is in the range of 5 to 18% of the total WC-Co component.

6. The hardfacing powder blend of claim 2, wherein said WC-Co and $W_2C$ metal particles have a mesh range of −140+325 (Tyler), and the matrix alloy particles have a mesh range of −80+325 (Tyler).

7. The hardfacing powder blend of claim 4, wherein said WC-Co and $W_2C$ metal particles have a mesh range of −140+325 (Tyler), and the matrix alloy particles have a mesh range of −80+325 (Tyler).

8. A blended hardfacing powder for deposition by welding comprised of: WC-Co metal particles 30 to 40% by weight; $W_2C$ metal particles 20–50% by weight; and 20 to 50% by weight of a matrix alloy containing carbon 2.7–3.3% by weight, iron 0.27–0.40% by weight, and nickel balance.

9. A blended hardfacing powder according to claim 8, wherein said WC-Co, $W_2C$ metal particles have a mesh range of −140+325 (Tyler) and said matrix alloy metal particles have a mesh range of −80+325 (Tyler).

10. A blended handfacing powder according to claim 8, wherein the total content of tungsten carbide in said powder is in excess of 50% by weight.

11. A hardfacing powder blend for deposition by plasma-transferred-arc welding comprised of: tungsten carbide particles of an amount at least 50% by weight of the powder, and a chromium-free matrix alloy including carbon 0.017–0.052% by weight, silicon at 4.3–4.7% by weight, boron at 2.7–3.3% by weight and iron at 0.27–0.40% by weight with nickel as the balance.

12. The hardfacing powder of claim 11, wherein said tungsten carbide particles are comprised of WC-Co particles at 30–40% by weight and $W_2C$ particles at 20–50% by weight.

* * * * *